US006253040B1

(12) United States Patent
Kopp et al.

(10) Patent No.: US 6,253,040 B1
(45) Date of Patent: Jun. 26, 2001

(54) OPERATIONAL METHOD FOR AN ELECTROGRAPHIC PRINTER OR COPIER

(75) Inventors: Walter Kopp, Taufkirchen; Martin Schleusener, Zorneding; Reinhard Apel, Vaterstetten, all of (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/331,141

(22) PCT Filed: Dec. 17, 1997

(86) PCT No.: PCT/DE97/02959

§ 371 Date: May 8, 2000

§ 102(e) Date: May 8, 2000

(87) PCT Pub. No.: WO98/27469

PCT Pub. Date: Jun. 25, 1998

(30) Foreign Application Priority Data

Dec. 18, 1996 (DE) ..... 196 52 843

(51) Int. Cl.[7] ..... G03G 15/06
(52) U.S. Cl. ..... 399/55; 399/53
(58) Field of Search ..... 399/53, 55, 29, 399/281, 285, 292, 293; 347/140

(56) References Cited

U.S. PATENT DOCUMENTS 5,006,897 * 4/1991 Rimai et al. ..... 399/55 X
5,235,385 * 8/1993 Rushing ..... 399/55
5,285,243 * 2/1994 Rimai et al. ..... 399/274
5,339,140 * 8/1994 Zeman et al. ..... 399/53
5,463,449 * 10/1995 Morse et al. ..... 399/55
5,734,955 * 3/1998 Gruber et al. ..... 399/292 X
5,742,885 * 4/1998 Wayman ..... 399/293
5,781,827 * 7/1998 Shimada et al. ..... 399/55

FOREIGN PATENT DOCUMENTS 29 30 785 C2 2/1980 (DE) .
0 494 454 B1 7/1992 (EP) .
0494454 A2 * 7/1992 (EP) .

OTHER PUBLICATIONS

Japanese Abstract, Publication No. 06067527, Publication Date Mar. 11, 1994.

Japanese Abstract, Publication No. 58121050, Publication Date Jul. 19, 1983.

Patent Abstracts of Japan, 58–121050, Jul. 19, 1983.*

Patent Abstracts of Japan, 06–067527, Mar. 11, 1994.*

* cited by examiner

*Primary Examiner*—Sandra Brase
(74) *Attorney, Agent, or Firm*—Schiff Hardin & Waite

(57) ABSTRACT

A method and apparatus for an electrographic printer or copier provides a first layer of toner particles is deposited on a first toner receiving surface by a force field. The amount of toner actually applied is detected at at least one point in the first layer. The force field is modified according to changes in the actual amount of toner from the predetermined amount of toner.

7 Claims, 4 Drawing Sheets

OPERATIONAL METHOD FOR AN ELECTROGRAPHIC PRINTER OR COPIER

BACKGROUND OF THE INVENTION

1. Field of the Invention

The invention is directed to a method for the operation of an electrographic printer or copier, whereby a layer containing toner particles, referred to in brief as toner layer, is deposited on a toner acceptance surface under the influence of a force field. At least a part of the deposited toner particles is transferred onto a second toner acceptance surface under the influence of a second force field, the transferred toner particles forming a second layer thereon.

2. Description of the Related Art

Such a method is implemented in the developer unit that is set forth in European Patent EP 0 494 454 B1. Given this developer unit, the toner particles are electrically charged in a toner reservoir wherein a toner-air mixture is located and are subsequently deposited on the first toner acceptance surface that is grounded or provided with a potential, being deposited thereon as toner layer under the influence of an electrical force field. Due to the rotation of a developer drum whose generated surface forms the toner acceptance surface, the deposited toner particles are conducted past a development gap between the developer drum and a toner image carrier.

The second toner acceptance surface is formed by the generated surface of the developer drum. At the transfer gap, the toner particles are transferred from the transfer drum onto the developer drum, where they form the second layer. Due to the rotation of the drum, the toner particles of the second layer are conducted past a developing gap between the developer drum and a toner image carrier. The toner image carrier carries a latent charge image onto which toner particles are selectively applied at the development gap, whereby a toner image arises. The toner image is then applied onto an ultimate image carrier, for example onto paper, from the toner image carrier with or without employment of an intermediate image carrier.

What is disadvantageous about the known method is that a monitoring of the developing process and, in particle, of the amount of toner output by the developer unit is not possible. When the toner amount per surface on one of the toner acceptance surfaces or the charge of the toner particles during developing as well lies below or above a predetermined rated value or, respectively, rated range, then the error is not recognized until the finished print image. A reaction thus ensues relatively late. The disturbances in the print image are particularly noticeable given picture elements in the print image that are printed large-area.

In the known method, it is also not possible to exactly set the toner mass per surface section on the toner acceptance surface or the toner charge per surface section, to keep it constant during printing mode and to potentially adapt it to specific print jobs.

Both dry toner as well as liquid toner are employed as toner. Given liquid toners, for example, mechanical devices with electrical auxiliary potential are employed for applying the toner. The toners that are employed can still be divided into a single-component and multi-component toner.

What are understood by electrographic printer are, in particular, electrophotographic printers, ionographic printers and magnetographic printers. It is also known to employ bands on which the toner layer is deposited instead of the developer drum or, respectively, the transfer drum.

The Abstract of Japanese Patent Application JP-A-06067527 explains a developer unit wherein the actual toner mass per surface section of the developer drum is regulated dependent on the sensor signal of a sensor with the assistance of a force field between a transfer drum and a developer drum.

U.S. Pat. No. 5,339,140 explains a developer unit wherein the charge of a toner particle layer on the developer drum is acquired with the assistance of a sensor unit. Dependent on the output signal of the sensor unit, a charging device that is arranged along the toner path is controlled such in a control circuit that the actual toner charge reaches a rated toner charge.

U.S. Pat. No. 5,285,243 explains a developer unit wherein the developing rate is acquired with the assistance of a sensor that acquires the toner mass per surface unit. The charging potential, the illumination, the bias potential or, respectively, the toner concentration is modified dependent on the acquired developing rate.

The Abstract of Japanese Patent Application JP-A-58121050 explains a developer unit with a developer drum. The charge of the toner particles on the developer drum are [sic] acquired with the assistance of a sensor. A charge unit is driven such in a control circuit dependent on the output signal of the sensor that the toner on the developer drum has a predetermined charge or, respectively, a predetermined surface potential.

SUMMARY OF THE INVENTION

An object of the invention is to specify a simple method for operating an electrographic printer or copier that enables developing with high quality.

The invention is based on the perception that characteristic quantities that critically define the quality of the developing process and, thus, critically define the quality of the print image as well must already be acquired during developing and not after the developing process has been terminated, in order to be able to react quickly given deviations of these characteristic quantities from rated values.

In the invention, the average actual toner mass per surface section is therefore acquired at at least one location of the first toner layer and/or second toner layer. What per surface section thereby means is that a relatively uniform layer is assumed and the toner mass that is acquired is referred to a defined surface section of the toner layer of, for example, 1 $cm^2$. The total area of the respective toner layer is employed as reference quantity. The average toner mass per surface section is also a criterion for the thickness of the layer.

In the invention, at least one of the force fields is modified in a first control circuit dependent on the deviation of the actual toner mass per surface section from a predetermined, average rated toner mass per surface section. When the actual toner mass is higher than the rated toner mass, then the force field is modified such that fewer toner particles are deposited on the toner acceptance surface. When the actual toner mass is smaller than the rated toner mass, then the force field is modified such that more toner particles are deposited on the toner acceptance surface. When actual toner mass per surface section and rated toner mass per surface section coincide, then the force field is not modified. As a result of these measures, the actual toner mass can be exactly set to the value of the rated toner mass and can be kept constant during printing operations. As required, the rated toner mass per surface section can also be modified during printing operations.

Which of the two force fields is modified is dependent on the specific parameters during printing. When, for example, the toner acceptance surfaces are made of an electrically conductive material and when the force fields are generated on the basis of difference in potential in which both toner acceptance surfaces participate or at least one of the toner acceptance surfaces participates, then the potential of the second toner acceptance surface cannot be arbitrarily selected when this toner acceptance surface is arranged on the developer drum. A change of the potential of the second toner acceptance surface would also influence the voltage in the development gap. However, it is not always possible or, respectively, expedient to modify this voltage. In this case, only the potential of the first toner acceptance surface, i.e. of the transfer drum, is modified during regulation.

Further, the average actual toner charge per surface section is acquired in the invention at at least one location of the first toner layer and/or second toner layer. The charge of the toner particles of the appertaining layer is then modified in a second control circuit dependent on the deviation between the actual toner charge per surface section and a predetermined rated toner charge per surface section. As a result of these measures, the toner charge per surface section is acquired as an important characteristic quantity of the developing process and is set to the value of the predetermined actual toner charge. During printing operation, the actual toner charge is kept constant at the value predetermined by the rated toner charge. The result is an improvement of the print images arising during developing.

The toner charge per surface section can be increased on both toner layers in order to in turn compensate charge losses during the transport of the toner particles on these layers. When the installation space in the developer unit is limited, then only the toner charge of the first toner layer or the toner charge of the second toner layer is modified by a single charging device.

For example, the control methods are combined in the fashion of a cascade control or of a relationship control. A control is also applied wherein the toner mass per surface section and the toner charge per surface section are placed in relationship, so that what is referred to as the mass-related toner charge is calculated as controlled quantity. According to a predetermined control strategy, the toner mass per surface section and/or the toner charge per surface section is modified given a deviation of the mass-related toner charge from a predetermined value. The mass-related toner charge is one of the most critical characteristic quantities of the developing process. When the mass-related toner charge is kept constant during the entire development process, then the same quantity of toner particles, whose charge lies in a predetermined range, is always available for developing. During the entire developing process, the toner particles thus deposit uniformly at the locations of the toner image carrier to be developed. The result is a high-quality print image.

When the predetermined rated toner charge per surface section is selected such that it is higher in amount than the toner charge per surface section immediately after the application of the toner particles onto the toner acceptance surface, then charge losses of the toner particle charges during transport on the toner acceptance surface can be compensated in that the toner charge is increased in any case in addition to the control of the toner charge.

In another exemplary embodiment of the invention, the voltage in a developing gap is taken into consideration given the prescription of the rated toner mass per surface section and/or of the rated toner charge per surface section. When an operator varies the voltage in the developing gap, for example when setting the contrast of the print image, then rated toner mass and rated toner charge are also to be automatically adapted in order to generate a high-quality print image.

A further aspect of the invention is directed to a developer unit for an electrographic printer or copier that, in particular, is utilized for the implementation of the above-explained methods. The technical effects cited above are thus also valid for the developer unit of the invention and the exemplary embodiments thereof.

BRIEF DESCRIPTION OF THE DRAWINGS

Exemplary embodiments of the invention are explained below with reference to the drawings. Shown therein are.

DETAILED DESCRIPTION OF THE PREFERRED EMBODIMENTS

Figure 1:
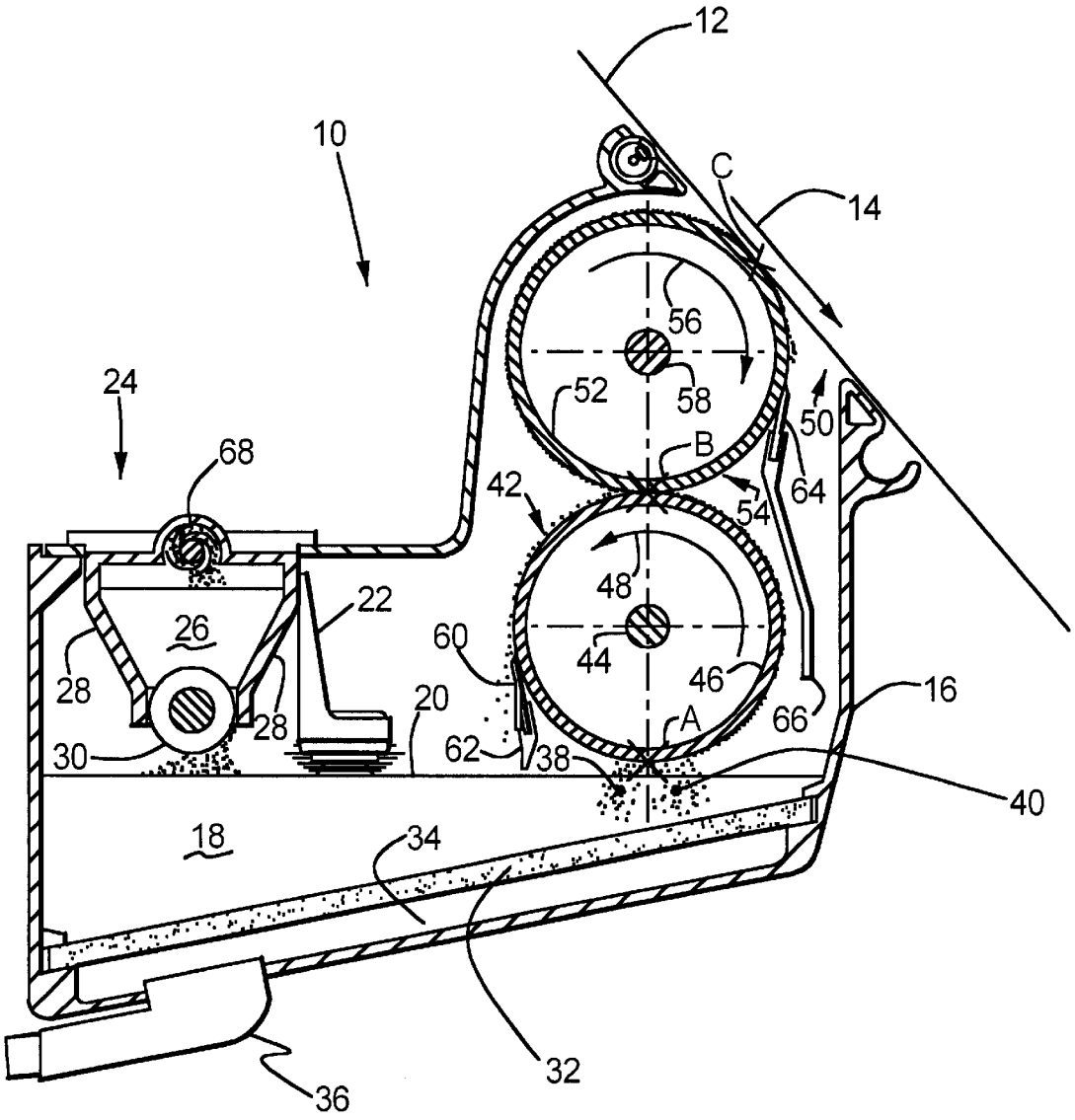
FIG. 1 a schematic illustration of a developer unit with a developer drum and a transfer drum.

FIG. 1 schematically shows the structure of a developer unit 10 at which a photoconductor band 12 is conducted past in the direction of an arrow 14. A latent charge image in which the charges are distributed according to the image information of the image to be printed is located on the photoconductor band 12 in the surface region facing toward the developer unit 10. The conveyor means for the photoconductor band 12 was not entered in FIG. 1 for the sake of simplicity in the illustration.

The developer unit 10 contains a container 16 in which a toner-air mixture 18 is located. Toner particles and air are mixed in roughly the ratio 1:10 in the mixture 18, as a result whereof the mixture 18 behaves like a liquid. A boundary surface 20 between the mixture 18 and the air contained in the developer unit 10 is relatively smooth. An ultrasound sensor 22 above the surface 20 acquires a filling level H of the mixture 18.

The mixture 18 is thereby generated from solid toner particles having an average size of approximately 10 $\mu$m that are supplied to the toner-air mixture 18 in defined amounts by a toner metering means 24. A toner particle supply 26 is located between inclined sidewalls 28 of the toner metering means 24, so that the toner particles are supplied funnel-like to a metering wheel 30. The metering wheel 30 has recesses along its circumference into which respectively identical quantities of toner particles are accepted. As a result of a rotational movement of the metering wheel 30, toner particles from the inside of the toner metering means 24 are supplied to the toner-air mixture 18 as soon as the ultrasound sensor 22 registers a drop of the boundary surface 20 below a predetermined rated height.

An air-permeable plate 32 composed of a porous polyethylene material is arranged in the floor region of the developer unit 10, air flowing into the toner-air mixture 18 large-area through said plate 32 from a chamber 34 lying below the plate 32.

Two corona wires 38 and 40 are located in the developer unit 10, these having a voltage of approximately −8 kV and negatively charging the toner particles of the mixture 18 in their proximity. The corona wires 38 and 40 transversely through the entire developer unit over a length that approximately corresponds to the expanse of the photoconductor band 12 transversely relative to the conveying direction 14 thereof. A transfer drum 42 whose axis 44 proceeds parallel to the corona wires 38 and 40 is arranged above the corona wires 38 and 40 and above the boundary surface 20. A conductive surface layer 46 has a potential of approximately −0.9 kV, so that the negatively charged toner particles—due to the influence of the electrical field between the corona wires 38, 40 and the transfer drum 42—are deposited on the surface layer 46 over the entire length of the corona wires 38 and 40. Given a rotation of the transfer drum 42 in the direction of an arrow 48, the deposited toner particles are in the direction of an opening 50 of the developer unit 10 for the delivery of toner particles. For the section shown in FIG. 1, the transport path of the charged toner particles proceeds through the developer unit 10 along the outside radius of the transfer drum 42 from a point A up to a point B.

In point B, the toner particles—under the influence of a further electrical field—are transferred onto a conductive surface layer 52 of a developer drum 54 that rotates in the direction of an arrow 56. The further electrical field lies between the surface layer 46 and the surface layer 52 charged to a potential of approximately −0.5 kV. The axis 58 of the developer drum 54 is arranged essentially parallel to the axis 44. For the section shown in FIG. 1, the toner particles, following the transfer in point B, are transported by the developer drum 54 along the outside radius of the developer drum 54 to a point C in the opening 50.

Individual toner particles that are not transferred from the transfer drum 42 to the developer drum 54 are removed from the surface layer 46 with the assistance of a stripper 60 before the respective region of the surface layer 46 is covered again with new charged toner particles. The stripper 60 proceeds over the entire length of the transfer drum 42 and is held by a stripper mount 62.

The latent charge image of the photoconductor band 12 is developed in the region of the opening 50 in that toner particles from the surface layer 52 deposit in charged areas of the photoconductor band 12. Toner particles remaining on the developer drum 54 are removed from the surface layer 52 by a further stripper 64 before new toner particles are again applied from the transfer drum 42. The stripper 64 proceeds over the entire length of the developer drum 54 and is held by a further stripper mount 66 that, at the same time, is also a baffle means for the toner particles detaching from the developer drum 54. The toner particles removed by the strippars 60 and 64 drop back into the mixture 18.

Toner that replaces the toner particles consumed during developing is supplied to the developer unit by a toner delivery means 68.

Figure 2:
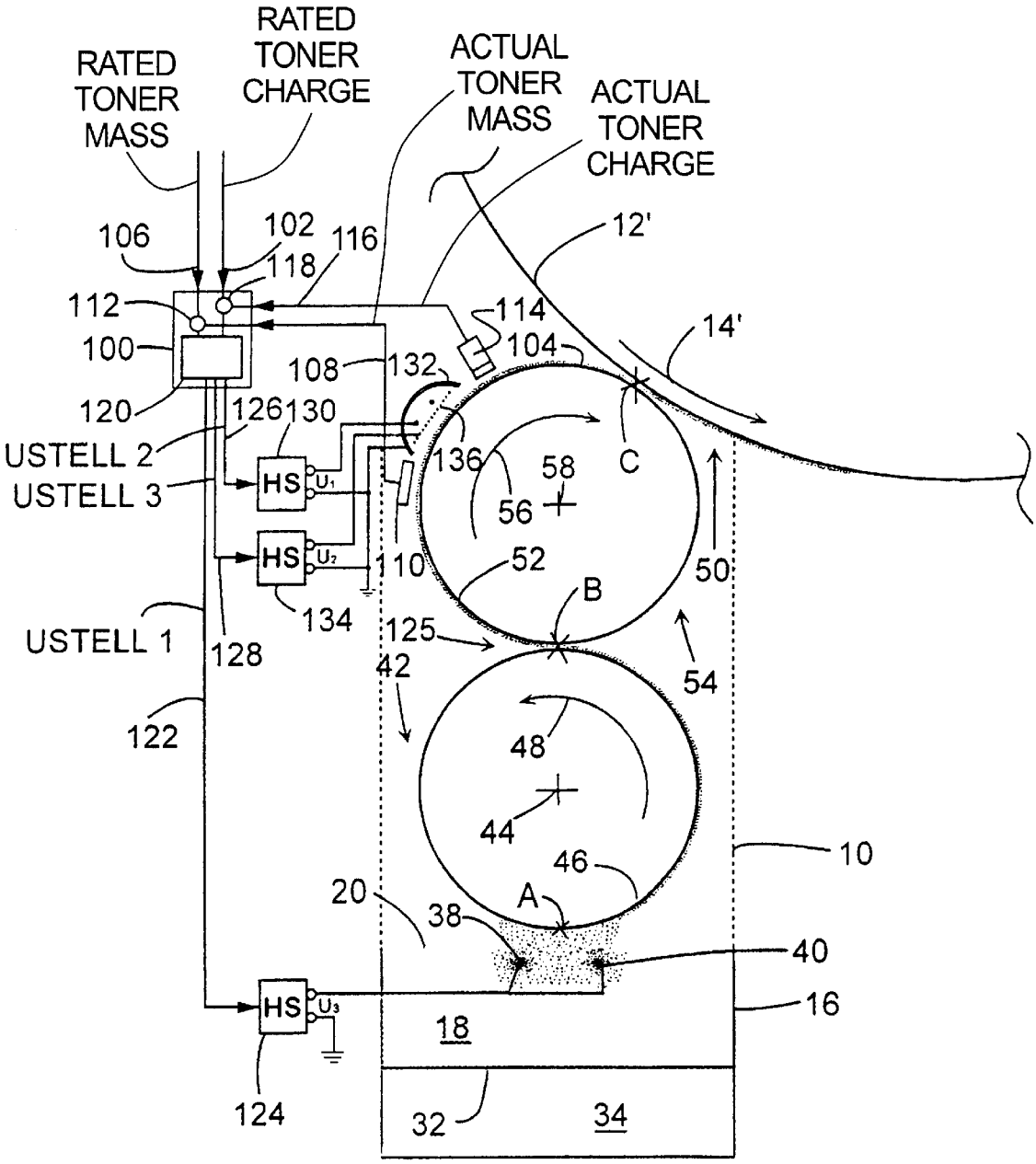
FIG. 2 a developer unit with a control means for controlling the mass-related toner charge on the developer drum with the assistance of a scorotron.

FIG. 2 shows the developer unit 10, whereby, however, a latent charge image is developed on a photoconductor drum 12' that is arranged at the developer unit 10 instead of the photoconductor band 12 (see FIG. 1). The photoconductor drum 12 [sic] rotates in the direction of an arrow 14'. A control means 100 to which a rated toner charge that, for example, refers to a specific surface section of a toner layer 104 on the developer drum 54 is prescribed via a line 102 is arranged at the developer unit 10. A rated toner mass for the surface section of the toner layer 104 is also prescribed for the control means 50 via a line 106. Via a line 108, the control means 50 also receives signals from an optical sensor unit 110. The optical sensor unit 110 contains a light transmitter, a light receiver as well as an evaluation unit. The light beamed out by the light transmitter is re-emitted to the receiver by the toner layer 104.

With reference to the re-emission behavior of the toner layer 104 dependent on the actual toner mass per surface section, the actual toner mass per surface section in the toner layer 104 is identified in the sensor unit 110. Via the line 108, the momentary value of the actual toner mass proceeds to the control means 100 wherein the difference between rated toner mass and actual toner mass is formed in a subtracter 112, whereby a toner mass error signal pends at the output of the subtractor 112. Alternatively, the sensor unit 110 can also contain a capacitative sensor with whose assistance the actual toner mass per surface section is determined in that the change of the dielectric properties of the toner layer 104 are [sic] acquired given a change of the toner mass per surface section.

A potential sensor unit 114 that has its output side connected to the control means 100 via a line 116 is also arranged close to the surface 52 of the developer drum 54 covered with the toner layer 104. The potential sensor unit 114 contains an electrode at which a potential that is determined by the potential of the developer drum 54 and by the totality of the toner charge that is located on the surface of the developer drum 54 in the field region of the electrode is influenced. The potential sensor unit 114 also contains an evaluation unit that determines the actual toner charge from the influenced potential.

The difference between rated toner charge and actual toner charge is formed in a subtractor 118 that is contained in the control means 50. A toner charge error signal pends at the output of the subtractor 118.

The two error signals of the subtractors 112 and 118 are supplied to a controller 120 that, for example, contains two PI regulators, whereof one generates a setting voltage USTELL1 dependent on the toner mass error signal on an output line 122 of the control means 100, said setting voltage USTELL1 being adjacent at a controlled power pack part 124. The controlled power pack part 124 generates a voltage U3 at its output that determines the potential on the corona wires 38 and 40. The voltage U3 is set dependent on the setting voltage USTELL1.

The voltage USTELL1 is prescribed such by the first PI regulator that the error signal of the subtractor 112 is reduced in amount and ultimately has the numerical value of "0". A first control circuit I thus contains the optical sensor unit 110, the control means 100, the power pack part 124 and the corona wires 38 and 40. The toner mass per surface section of the toner layer 104 is regulated with the assistance of the control circuit I in that, given too low a toner mass per surface section, the potential of the corona wires 38 and 40 is increased, so that more toner particles deposit on the surface 46 of the transfer drum 42. Since these toner particles are transferred from the transfer drum 42 onto the developer drum 54 in the region of a transfer gap, the toner mass per surface section of the toner layer 104 also ultimately increases. When the actual toner mass lies above the value that is prescribed by the rated toner mass, then the potential of the corona wires 38 and 40 is lowered. The result is that fewer toner particles deposit on the surface 46 of the transfer drum 42. Correspondingly fewer toner particles are then transferred onto the developer drum 54 at the transfer gap 125. Ultimately, one succeeds in keeping the actual toner mass per surface section on the surface 52 of the developer drum 54 constant according to the predetermined rated toner mass per surface section with the assistance of the control circuit I.

Dependent on the toner charge error signal of the subtractor 118, the second PI regulator contained in the controller 120 generates a setting voltage USTELL2 on a line 126 and generates a setting voltage USTELL3 on a line 128, whereby it is essentially the setting voltage USTELL3 that is modified during regulation. The setting voltage USTELL2 is adjacent at a controlled power pack part 130 that, dependent on the value of the setting voltage USTELL2, generates a voltage U1 that influences the charge behavior of a scorotron 132 at its output. The setting voltage USTELL3 is adjacent at the input of a controlled power pack part 134 that, dependent on the value of the setting voltage USTELL3, generates a voltage U2 at its output that is adjacent at a control grid of the scorotron 132. The charge behavior of the scorotron 132 can be controlled better via the control grid 136 than via the voltage U1.

The second PI regulator therefore prescribes the setting voltage USTELL3 essentially such that the error signal of the subtractor 118 is reduced in amount and ultimately has the numerical value of "0" until noise quantities lead to a new control procedure. A second control circuit II thus contains the potential sensor unit 114, the control means 100, the power pack part 130 or, respectively, 134 and the scorotron 132. When the actual toner charge per surface section on the toner layer 104 decreases, then the voltage U2 is set such, that the charge behavior of the scorotron 132 is boosted. When the actual toner charge per surface section of the layer 104 exceeds the predetermined rated value, then the voltage U2 is modified such, that fewer charges are applied onto the toner layer 104 by the scorotron 132. With the control circuit II, one succeeds in keeping the actual toner charge per surface section constant according to the predetermined rated toner charge per surface section during the developing process.

In a further exemplary embodiment, the control means 100 is given a mass-referred rated toner charge instead of the rated toner charge per surface section and instead of the rated toner mass per surface section. The mass-referred toner charge qT is calculated according to the following equation.

$$qT = \frac{QT}{MT}$$

whereby QT is the toner charge per surface section and MT is the toner mass per surface section. The prescribed, mass-referred rated toner charge is compared to a mass-referred actual toner charge that is determined from actual toner charge and actual toner mass with the above-recited equation. The mass-referred toner charge QT on the layer 104 is ultimately kept constant during the developing process on the basis of a predetermined control strategy of the control means 100.

Figure 3:
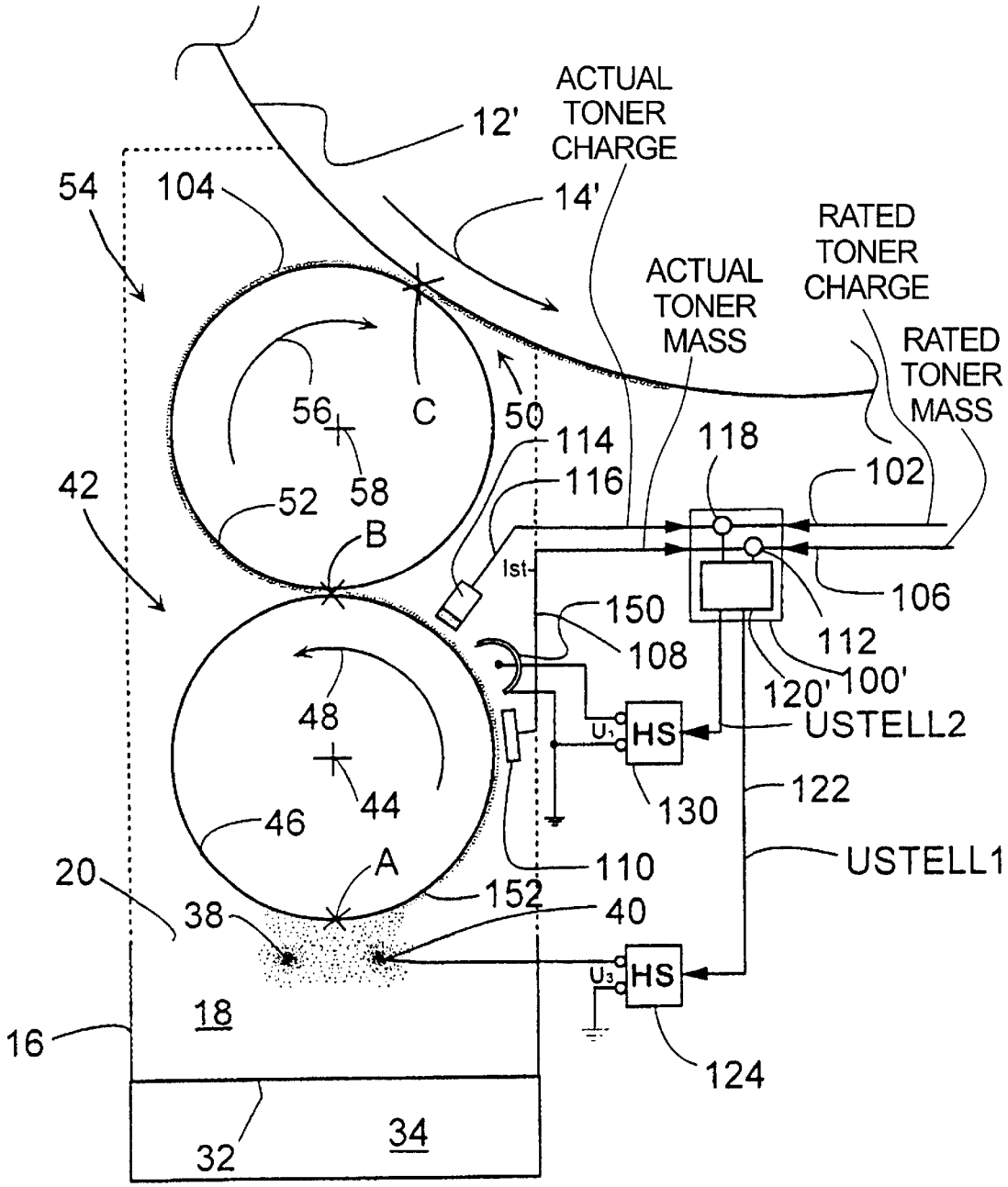
FIG. 3 a developer unit with a control means for controlling the mass-related toner charge on the transfer drum with the assistance of a corotron.

FIG. 3 shows the developer unit 10 with a control means 100' for controlling the mass-referred toner charge qT on the transfer drum 42 with the assistance of a corotron 150. The control means 100' is constructed like the control means 100 (see FIG. 2), but contains a regulator 120' instead of the regulator 120, this having only the two output lines 122 and 126. This is to be attributed thereto that the corotron, which is constructed significantly simpler that the scorotron 132 (see FIG. 2), has no control grid, so that the voltage U2 generated by the power pack part 134 is eliminated.

By contrast to FIG. 2, the optical sensor unit 110, the potential sensor unit 114 and the corotron 150 are now arranged close to the transfer drum 42, so that characteristic quantities of a toner layer 152 on the surface 46 of the transfer drum are acquired or, respectively, influenced.

The regulation of the toner mass per surface section in the control circuit I ensues as explained above with reference to FIG. 2. For regulating the toner charge per surface section, the control means 100' only prescribes the setting voltage USTELL2. The setting voltage USTELL2 is selected such that the actual toner charge per surface section of the toner layer 152 adjusts to the value prescribed by the rated toner charge per surface section.

Figure 4:
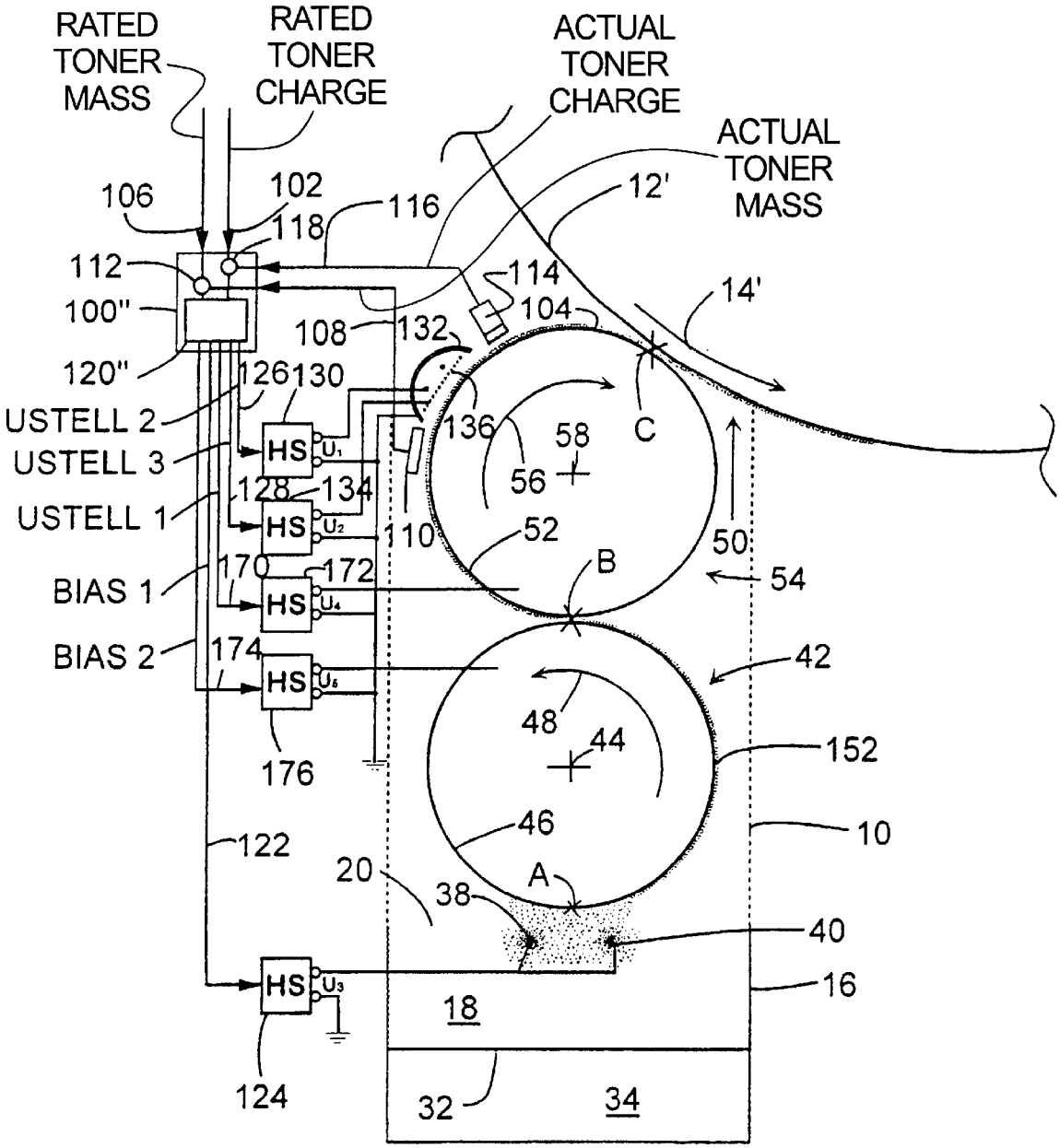
FIG. 4 a developer unit with a control means for controlling the mass-related toner charge taking the potentials on the developer drum and the transfer drum into consideration.

FIG. 4 shows the developer unit 10 with a control device for the regulation of the mass-referred toner charge qT taking the electrical potentials on the developer drum 54 and the transfer drum 42 into consideration. The control ensues with a control means 100" that is constructed essentially like the control means 100 (see FIG. 2). Instead of the regulator 120, however, the control means 100" contains a regulator 120" that also takes the momentary potential of the developer drum 54 and of the transfer drum 42 into consideration when regulating. These potentials derive, for example, from the contrast value that an operator of the printer has selected.

The control of the developing process ensues essentially as explained above with reference to FIG. 2. Additionally, the control means 100" is connected via a line 170 to a controlled power pack part 172 and via a line 174 to a controlled power pack 176. A bias signal BIAS1 is communicated on the line 170. Dependent on the value of the bias signal BIAS1, a voltage U4 is generated in the power pack part 172, this voltage being applied to the conductive surface of the developer drum 54. The value of the potential on the developer drum 24 [sic] that is respectively selected influences both the control circuit I as well as the control circuit II since it co-determines the value of the rated toner charge and of the rated toner mass.

A further bias signal BIAS2 that determines what voltage U5 is generated at the output of the power pack part 176 is communicated on the line 174. The voltage U5 determines the potential on the surface 46 of the transfer drum 42. The potential on the transfer drum 42 also influences both control circuits I and II.

The difference of the voltage U5 and U3 determines the toner mass per surface section deposited on the transfer drum 42 and also determines the toner charge per surface section to a certain extent. The difference of the voltages U4 and U5 determines the toner mass per surface section transferred from the transfer drum 42 onto the developer drum 54. The difference between the voltage U4 and the potential on the surface of the photoconductor drum 12' determines the toner mass per surface section that is transferred from the developer drum 54 onto the photoconductor drum 12' on regions in which toner particles are deposited during developing. Due to the image-wise charge distribution on the surface of the photoconductor drum 12', the inking with toner particles for each picture element of the latent charge image is determined by the respective difference in potential between the voltage U4 and the local photoconductor potential.

Although other modifications and changes may be suggested by those skilled in the art, it is the intention of the inventors to embody within the patent warranted hereon all changes and modifications as reasonably and properly come within the scope of their contribution to the art.

100,100',100" control means
102 line
104 tonerlayer
106, 108 line

110 optical sensor unit
112 subtractor
114 potential sensor unit
116 line
118 subtractor
120,120',120" regulator
122 output line
124 controlled power pack part
125 transfer gap
126, 128 line
130 controlled power pack part
132 scorotron
134 controlled power pack part
136 control grid
150 corotron
152 toner layer
170, 174 line
172, 176 controlled power pack part
USTELL1 setting voltage
USTELL2 setting voltage
USTELL3 setting voltage
I, II control circuit
qT mass-referred toner charge
QT toner charge per surface section
MT toner mass per surface section
U1 through U5 voltage
BIAS1, BIAS2 bias signal

What is claimed is:

1. A method for operation of an electrographic printer or copier, comprising the steps of:

depositing a first layer containing toner particles on a first toner acceptance surface under influence of a force field, the toner particles being taken from a toner supply;

transferring at least a part of the deposited toner particles under influence of a second force field, being transferred from the first toner acceptance surface onto a second toner acceptance surface on which the transferred toner particles form a second layer;

sensing an actual toner mass per surface section at at least one location of the first layer and/or of the second layer; and modifying at least one of the force fields by a first control circuit dependent on deviation of the actual toner mass from a predetermined rated toner mass, sensing actual toner charge per surface section at at least one location of the first layer and/or of the second layer; and modifying charge of the toner particles of at least one of the first and second layers in a second control circuit dependent on deviation of the actual toner charge from a predetermined rated toner charge.

2. A method for operation of an electrographic printer or copier according to claim 1, wherein the rated toner charge lies above the value of the toner charge of the first layer and/or of the second layer immediately after the application of the toner particles.

3. A method according to claim 1, further comprising the step of:

changing one of rated toner mass and rated toner charge when changes occur in a voltage in at least one of:

a development gap in which the toner particles of the second toner acceptance surface are transferred onto a toner image carrier; and a transfer gap in which the toner particles are transferred from the first toner acceptance surface to the second toner acceptance surface.

4. A developer unit for an electrographic printer or copier, comprising:

a first toner acceptance surface for acceptance of a first layer containing toner particles;

a second toner acceptance surface for acceptance of a second layer containing toner particles;

a first field generating means for generating a first force field with which toner particles from a reservoir are deposited onto the first toner acceptance surface;

a second field generating means for generating a second force field with which at least a part of the deposited toner particles are transferred from the first toner acceptance surface to the second toner acceptance surface;

at least one sensor unit for acquiring the actual toner mass per surface section of at least one of the first layer and of the second layer; and a first control means that modifies strength of at least one of the force fields dependent on the deviation of the actual toner mass per surface section of the layer from a predetermined rated toner mass, at least one charging device arranged close to at least one of the first toner acceptance surface and the second toner acceptance surface for charging the toner particles on the respective toner acceptance surface;

at least one sensor unit for acquiring the actual toner charge per surface section of at least one of the first layer and of the second layer; and a second control means that modifies charge behavior of the charging device dependent on deviation of the actual toner charge from a predetermined rated toner charge.

5. A developer unit according to claim 4, wherein the charging device is one of a corotron and a scorotron.

6. A developer unit according to claim 4, wherein at least one of the toner acceptance surfaces is electrically conductive and has a bias potential.

7. In an apparatus for printing or copying, the improvement comprising:

a developer unit according to claim 4.

* * * * *